United States Patent [19]

Weydemuller

[11] 4,192,275

[45] Mar. 11, 1980

[54] ELECTRONIC IGNITION SYSTEM

[76] Inventor: Donald C. Weydemuller, 21418 Bloomfield Ave., #15, Lakewood, Calif. 90715

[21] Appl. No.: 738,283

[22] Filed: Nov. 3, 1976

[51] Int. Cl.[2] ..... F02P 3/04

[52] U.S. Cl. ..... 123/148 E; 123/148 B; 123/148 S; 123/146.5 D; 315/209T

[58] Field of Search ..... 123/148 E, 148 CB, 148 B, 123/148 S, 146.5 D, 179 BG; 315/209 T; 331/109, 182, 183; 328/172

[56] References Cited

U.S. PATENT DOCUMENTS

| | | | |
|---|---|---|---|
| 2,953,719 | 9/1960 | Guiot | 315/209 T |
| 2,976,461 | 3/1961 | Dilger et al. | 123/148 E |
| 3,032,683 | 5/1962 | Ruckelshaus | 315/209 T |
| 3,175,123 | 3/1965 | Dilger | 123/148 E |
| 3,297,954 | 1/1967 | Wiley | 328/172 |
| 3,331,965 | 7/1967 | Andreasen | 331/183 |
| 3,408,536 | 10/1968 | Tibbs | 123/148 E |
| 3,443,555 | 5/1969 | Gove | 123/148 E |
| 3,545,419 | 12/1970 | Nolting | 123/148 CB |
| 3,593,696 | 7/1971 | Guido | 123/148 E |
| 3,626,910 | 12/1971 | Porsche et al. | 123/148 E |
| 3,673,998 | 7/1972 | Phillips | 123/148 E |
| 3,745,985 | 7/1973 | Höhne | 123/148 S |
| 3,853,106 | 12/1974 | Canup | 123/148 E |
| 3,868,938 | 3/1975 | Trass | 123/148 E |
| 3,875,920 | 4/1975 | Williams | 123/148 E |
| 3,897,767 | 8/1975 | Gordon et al. | 123/148 E |
| 3,926,557 | 12/1975 | Callies et al. | 123/148 E |
| 3,938,490 | 2/1976 | Snyder et al. | 123/148 E |
| 3,941,108 | 3/1976 | Phillips | 123/148 E |
| 3,945,362 | 3/1976 | Neuman et al. | 123/148 E |
| 3,993,035 | 11/1976 | Gerry | 123/148 E |

*Primary Examiner*—Charles J. Myhre
*Assistant Examiner*—Andrew M. Dolinar
*Attorney, Agent, or Firm*—John Holtrichter, Jr.

[57] ABSTRACT

A solid state ignition system operating from a relatively low potential direct current input source for use with an internal combustion engine in which a combustible gaseous mixture is detonated by means of the introduction therein of a spark produced by a relatively high potential, high frequency, constant current pulse generator in response to ignition timing signals associated with the engine, the generator including a relatively high frequency pulse energy oscillator triggered by the ignition timing signals and providing such pulse energy to a circuit producing constant current pulses of such energy over a relatively wide input potential operating range, the high frequency continuous wave pulse energy then being power amplified to operate a solid state switch opening and closing the primary circuit of transformer circuitry coupled to the engine's spark plugs.

4 Claims, 9 Drawing Figures

ELECTRONIC IGNITION SYSTEM

BACKGROUND OF THE INVENTION

The background of the invention will be set forth in two parts.

FIELD OF THE INVENTION

This invention relates to ignition systems for internal combustion engines and more particularly to solid state internal combustion ignition systems.

DESCRIPTION OF THE PRIOR ART

Conventional combustion engines require some means for igniting a combustible gaseous or vapor mixture in each cylinder at the proper time for efficient engine operation. The ignition is usually accomplished by a high voltage pulse provided at the center electrode of a spark plug extending into the engine's combustion chamber, causing a spark to bridge the gap between the center electrode and the plug's grounded frame.

For many years, the high potential energy delivered to the spark plugs in an ignition system has been generated in an electrical circuit comprising a relatively low potential storage battery connected to one side of a primary winding of a step up transformer. An engine-actuated switch, which temporarily grounds the other side of the primary winding to complete the primary circuit, induces a high potential across the secondary winding of the ignition transformer which is connected through a distributor and appropriate high tension electrical cable to the spark plugs in a sequence determined by the distributor in accordance with the engine's design.

It has been found that at relatively high engine speeds, the spark plug potential available at each spark plug is markedly less than that available at lower speeds. This is because the relatively large magnetic flux changes in the transformer, which are necessary to generate the high potential, are not obtainable when the period between each pulse of energy is shortened to the extent necessitated by high engine speed. With lower spark potential, the problem arises of having insufficient ignition of the combustible materials which lessens engine efficiency and increases the exhausting of hydrocarbon emissions from the engine. In order to overcome this problem, much effort has been directed to develop several types of solid state or transistorized ignition systems.

Most of the popular transistorized systems do overcome the aforementioned problem related to high speed operation in that the spark plug potential is maintained at a relatively high level over most of the engine's speed operating range. However, the duration of the spark is relatively short, and a higher than desirable amount of the combustible material is still not completely burned.

One technique that has been proposed is to employ a Jensen type oscillator having a control winding which acts to saturate a magnetic core of a multi-winding transformer. Spark energy is provided by this system when the current flow through the control winding is cut off to allow the feedback windings of the transformer to become effective and thereby instigate oscillation.

It should therefore be evident that an electronic ignition system that provides relatively high potential, high frequency, optimum constant amplitude ignition energy would constitute a significant advancement in the art.

SUMMARY OF THE INVENTION

In view of the foregoing factors and conditions of the prior art, it is a primary object of the present invention to provide a new and improved electronic ignition system.

Another object of the present invention is to provide a highly efficient electronic ignition system that produces a relatively high constant potential, high frequency pulse ignition energy over a wide range of d.c. input potential.

Still another object of the present invention is to provide a highly reliable electronic ignition system, the output of which is relatively unaffected by the heavy power drain of a storage battery during the period an engine's starting motor is energized.

Yet another object of the present invention is to provide an electronic ignition system that includes a safety turn-off feature when the system is energized but the engine is not operating.

Still a further object of the present invention is to provide an electronic ignition system which rectifies high frequency pulse ignition energy and applies the rectified energy across a capacitor that stores such energy until discharged by a spark generated across the points of a spark plug connected across the capacitor.

In accordance with the present invention, an electronic ignition system for use with an internal combustion engine includes a triggered oscillator circuit having a relatively high frequency energy generator portion providing pulses of oscillator energy in response to ignition timing signals. A constant current pulse circuit is coupled to the oscillator circuit for providing constant current pulses of energy in response to the pulses of oscillator energy. The invention also includes an output circuit coupled to the constant current pulse circuit for providing relatively high potential, high frequency, constant current combustion initiating pulses of output energy in direct relationship to and over the engine frequency operating range of the ignition timing signals. Still another embodiment of the invention rectifies high frequency pulse ignition energy from an electronic ignition system and applies this energy across a capacitor that is connected in parallel (through a distributor) with the spark plugs in the ignition system. Thus, the capacitor stores the energy until it is discharged when the potential across the spark plug points is great enough to cause a spark to jump the gap.

In accordance with certain embodiments of the invention, the input circuitry may include a novel circuit which discontinues the operation of the triggered oscillator in the event that the system is left in an energized condition while the engine is not operated and a timing signal is continuously presented to the system. Also, the system may include an energy reservoir which provides temporary power to the system's output circuitry in the event that its primary input potential drops below a level to adequately maintain the high potential of the combustion initiating pulses.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawing in which like reference characters refer to like elements in the several views.

DESCRIPTION OF THE PREFERRED EMBODIMENTS

Figure 1:
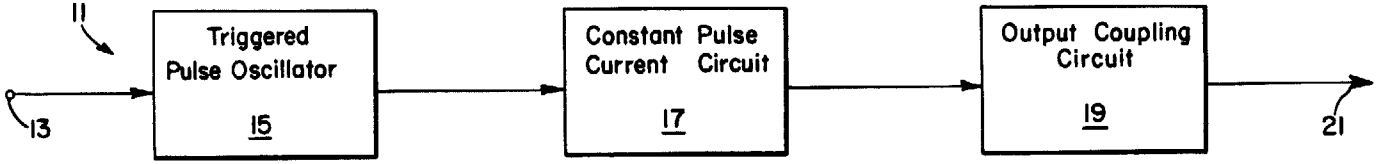
FIG. 1 is a block diagram of an electronic ignition system according to the present invention.

Referring now to the drawings and more particularly to the block diagram of FIG. 1, there is shown an electronic ignition system 11 for use with an internal combustion engine (not shown). Either an ignition timing signal in the form of a voltage pulse of energy or the closing of a switch (points) usually located in the engine's distributor is coupled or connected to the input terminal 13 of a relatively high frequency oscillator 15.

The oscillator 15 is of the type which will produce an output only when triggered by the ignition timing signal, and for as long as the timing signal is present. Although the frequency of oscillation for best operation has been found to be about 5 kHz, the invention provides advantageous results in the range from about 4 kHz to 20 kHz. Preferably, the input switching timing signal has a relatively fast rise and fall time characteristic, generally $<0.1$ μs. In the case where the timing signal is provided by the opening and closing of ignition points in a distributor, the trigger pulse width will depend upon the cam angle as well as the RPM. Converted into time:

$$\text{Pulse Width} = \frac{\text{Cam Angle}}{360^\circ} \times \frac{1}{\frac{\text{Engine RPM}}{2}} \text{ sec.}$$

The output pulses of relatively high frequency generated by the oscillator 15 are coupled to the input of a constant-current pulse circuit 17. This circuit senses and compensates for any changes in voltage supplied to the system so that the pulses coupled to an output coupling circuit 19 have a constant pulse current magnitude over the operating range of supply voltage for the system 11.

The output coupling circuit 19 may include a step up transformer, the output winding which provides, at its output terminal 21, the ignition timing signal-synchronized constant current pulses of high voltage, high frequency energy directly to an internal combustion engine's spark distribution system (not shown).

Figure 2:
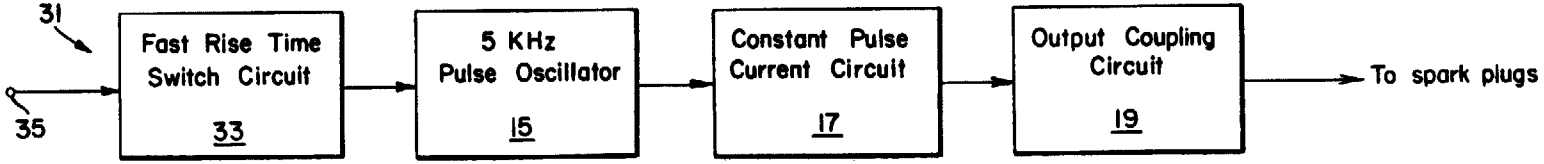
FIG. 2 is a block diagram according to one embodiment of the present invention.

FIG. 2 illustrates another embodiment of the invention. Here, the system 31 is shown to include a fast rise time solid state switch circuit 33 having an input connected to a set of distributor points, for example, at 35. The switch circuit isolates the points from the input to the oscillator 15 and generally provides a better shaped trigger signal to the oscillator.

Figure 3:
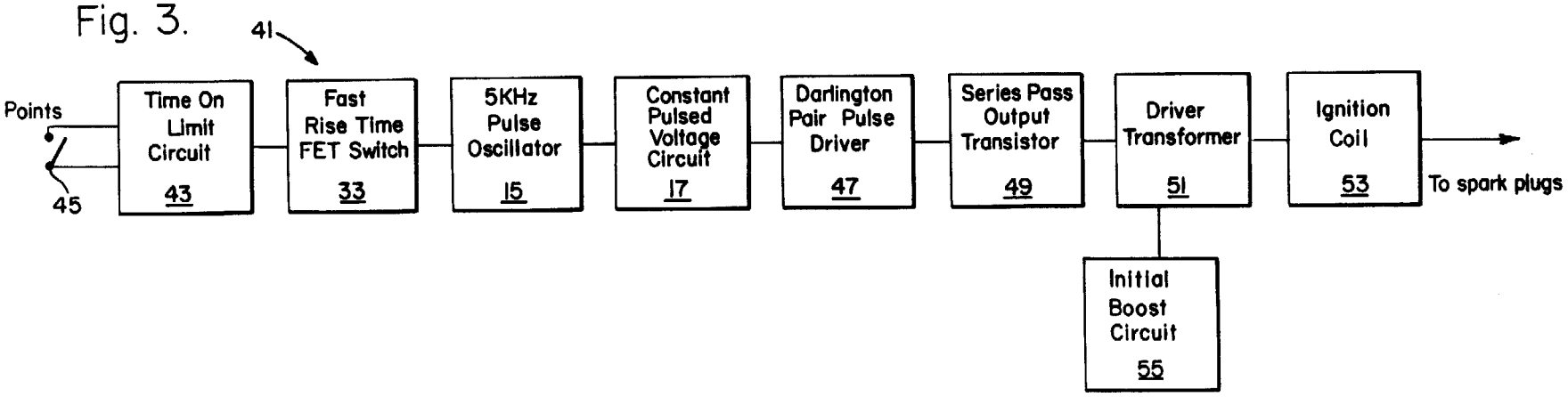
FIG. 3 is a block diagram of an electronic ignition system according to another embodiment of the present invention.
Figure 4:
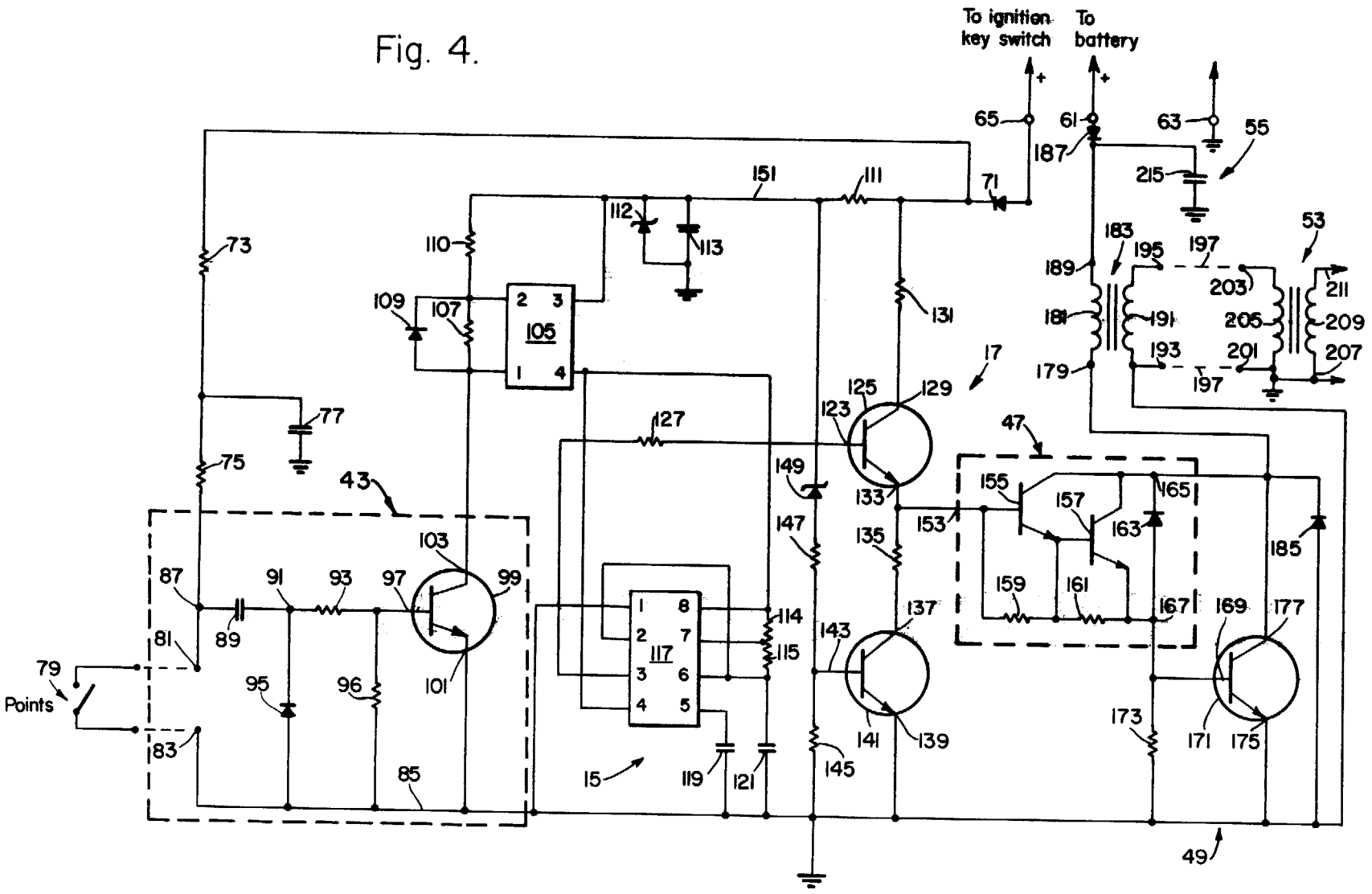
FIG. 4 is a schematic diagram of the ignition system of FIG. 3.

This system can further be expanded, as shown by system 41 in FIG. 3, to include a safety, time-on limit circuit 43 located between points 45 and the fast rise time switch 33. Also provided in the system 41 is a pulse driver circuit 47 and an output switching circuit 49 coupled between the output of the constant pulse current circuit 17 and a driver transformer 51. In this embodiment of the invention, the output of the driver transformer is coupled to a conventional ignition "coil" 53. In order to obviate any possible problem of providing a weakened "spark" to the spark plugs when the engine is being started by a starting motor due to its very heavy current drain, this preferred system further includes a boost circuit 55 which stores energy therein prior to the use of the starting motor, and which provides to the driving transformer circuit 51 a continuous high level of source energy through the aforementioned period of reduced potential level. A more complete description of this presently preferred embodiment is provided in connection with the schematic diagram shown in FIG. 4.

It can be seen in this figure that a source of primary power, usually in the form of a storage battery (not shown), is connected to a positive power input terminal 61, a negative terminal 63, and through an ignition switch (not shown) to a switched positive input power terminal 65. When positive potential is provided to terminal 65, it is applied to circuits 15, 17, 33, 43 and 47 through a conventional reverse-polarity protective diode 71, while a positive potential is always applied to terminal 61 and circuits 49, 53 and 55 (see FIG. 3).

Resistors 73 and 75 act as a voltage divider and filter network in conjunction with capacitor 77. In the time-on limit circuit of FIG. 4, conventional ignition points 79 are connected to the timing signal input terminals 81 and 83, the latter being connected to the common bus 85 or ground, while the former connects the junction 87 of resistor 75 and a timing capacitor 89. The other side of the capacitor 89 is connected to the junction 91 of resistor 93 and the cathode of diode 95. Timing pulses propagating through capacitor 89 and appearing between ground and the junction 91 are seen across the lower leg of a voltage divider circuit comprising the resistor 93 and a resistor 96 connected between a base terminal 97 of an NPN transistor 99 (such as a 2N2222, for example) and ground.

The emitter terminal 101 of transistor 99 is grounded and its collector terminal 103 is connected to a conventional FET switch circuit 105 in parallel with a load resistor 107 and a protective diode 109. Source potential is provided to the FET switch (terminal 105-2) and the collector of transistor 99 through a current limiting resistor 110. The FET switch circuit 105 is utilized because of its fast rise and fall time characteristic. However, other circuits having similar attributes may be utilized. Primary source potential is provided to terminal 105-3 of the FET switch 105 and to transistor 99 by the use of a series resistor 111 and a parallel peak voltage limiting filter combination of Zener diode 112 and capacitor 113. The diode voltage rating should be about a volt or two above the primary source potential.

The output of the switch circuit 105 is provided at terminal 105-4 thereof and is coupled directly to terminals 117-4 and 117-8, and through resistor 114 to terminal 117-7 and also through resistor 115 to terminal 117-6 of a conventional oscillator type integrated circuit (IC) 117, such as an NE 555, for example. Pin 117-1 of IC 117 is grounded while a decoupling capacitor 119 is provided between pin 117-5 and ground. Capacitor 121 is connected between pin 117-6 of IC 117 and ground and functions with resistor 115 to determine the frequency of operation of the oscillator circuit 15.

The output high frequency pulse energy from the oscillator circuit is coupled from terminal 117-3 to the base 123 of an NPN transistor 125 in the constant-current pulse circuit 17 through a current limiting resistor 127. The collector electrode 129 of the transistor 125 derives its operating potential through a resistor 131, and the emitter electrode 133 is connected to ground through a series resistor 135 and the collector 137-emitter 139 junction of an NPN transistor 141. The base 143 of this transistor is connected to a voltage divider arrangement comprising grounded resistor 145 and resistor 147 leading to Zener diode 149, the cathode of which is coupled to the primary source potential at bus 151 downstream of the resistor 111. The voltage rating of this Zener diode is chosen to be about 3 or 4 volts less than the source potential so that the diode 149, resistors 145, 147 and transistor 141 act as a voltage sensing circuit which limits the current output of the transistor 125 to compensate for changes of the primary source potential. For example, in a 12 volt system, the diode 149 may be rated at 9 volts, while resistors 145, 147 divide the voltage present at the anode of diode 149 in a 1-to-3 ratio.

The input 153 of the pulse driver circuit 47 is coupled to the output of the circuit 17 at the emitter terminal 133 of transistor 125. In this embodiment, the circuit 47 is a conventional Darlington pair incorporated in a unitary package and includes NPN transistors 155 and 157, and resistors 159 and 161 appropriately connected between associated base/emitter terminals. As is common in Darlington pair packaging, a protective diode 163 is connected across output terminals 165 and 167, the latter being connected to the base electrode 169 of a series-pass NPN transistor 171 and to a resistor 173 to ground, in the output switching circuit 49. The emitter 175 is connected to ground while the collector terminal 177 of transistor 171 is connected to terminal 165 of circuit 47 and to terminal 179 of the primary winding 181 of the driver transformer 183 in the driver transformer circuit 53. Another protective diode 185 is provided across the collector-emitter terminals of transistor 171, and an appropriately poled diode 187 provides primary source potential from the unswitched terminal 61 to the opposite end 189 of the primary winding 181.

The transformer 183 includes a secondary winding 191 providing, in this case, a 1:25 step up ratio between primary and secondary. A first end 193 of the winding 191 is connected to ground and the first end 193 and a second end 195 are connected through appropriate insulated cabling 197 to opposite ends 201 and 203 of a primary winding 205 of a conventional ignition coil (transformer) 53. An end 207 of the transformer's secondary winding 209 is grounded, and the high potential end 211 is appropriately connected to an ignition distributor (not shown).

Figure 5A:
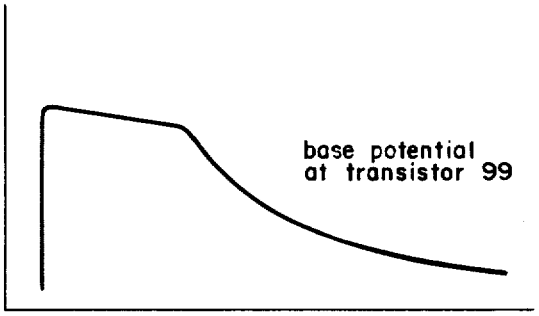
FIGS. 5*a*–5*d* are diagrammatic illustrations of voltages at specific points in the electronic ignition system of FIG. 4.
Figure 5B:
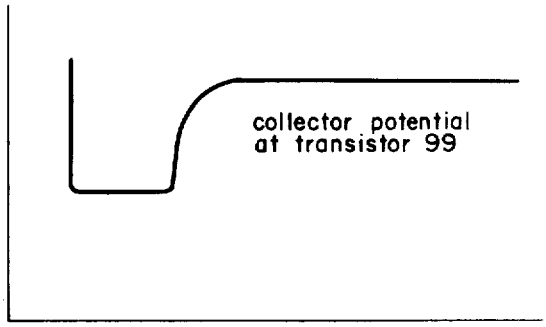
Figure 5C:
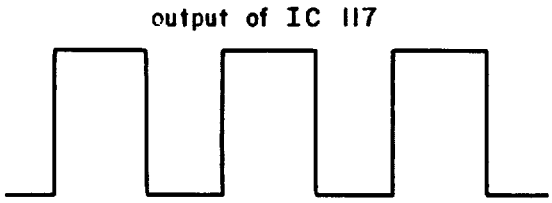
Figure 5D:
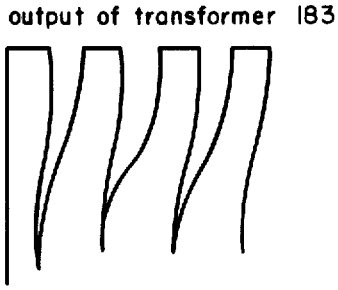

In operation, when points 79 close, the primary potential source (usually 12 volts), is dropped across resistors 73 and 75 to ground through the points 79, and there is no timing signal input at junction 87. However, when the points 79 first open, the base of transistor 99 sees about 7 volts peak and it starts to conduct. The voltage at the base decreases at first gradually as capacitor 89 changes. Once changed this capacitor is charged, the voltage at the base electrode 97 drops off more rapidly, as seen in FIG. 5. Diode 95 allows capacitor 89 to discharge very quickly just as the points 79 close. This diode also prevents capacitor 89 from discharging through the base-to-emitter leakage path in transistor 99, and places zero voltage at junction 91. At this time, transistor 99 is turned off (ceases to conduct), as shown in FIG. 5*b* by the voltage curve at the collector electrode 103.

When transistor 99 is conducting, the collector approaches ground potential, and the primary 12 volt source potential appears across a voltage divider circuit comprising resistors 107 and 110. In the conducting state of this transistor, diode 109 is effectively a short across resistor 107, and resistor 110 and resistor 111 act to limit transistor current to a desired value. The function of diode 109 is to bypass pulse kickback when transistor 99 rapidly stops conducting. This protects the input circuit of the FET switch 105 from damage.

The FET switch 105 is "turned on" when the voltage at its input terminal 105-1 drops to near zero by the conduction of transistor 99. This action cause the output of the switch 105, seen at its terminal 105-4 to very rapidly go from zero to a predetermined high "on" potential (usually the regulated potential on bus 151). This voltage is applied to the input voltage terminals 117-4 and 117-8 of the oscillator IC 117, which causes it immediately to start oscillating at a predetermined frequency determined by resistor 115 and capacitor 121. The duty cycle of this oscillating state is determined by resistor 114, and is usually set at about 50 percent. For a frequency of 5 kHz and a 50% duty cycle, resistor R114 is 1.3 k ohms, while resistor R115 is 13 k ohms and capacitor 121 has a capacitance of 0.01 $\mu$fd.

The output signal from the oscillator 117 is provided at terminal 117-3 and is in the form of pulses of relatively high frequency (preferably approximately 5 kHz) having a repetition rate and duration determined by the timing signal, provided in this embodiment by points 79. The pulse oscillator energy is coupled through the current limiting resistor 127 to the base electrode 123 of transistor 125.

In order to provide a desired constant high pulse potential to the spark plugs even when the primary potential source varies in magnitude, as is often the case in practice, circuit 17 is provided to compensate for such potential (voltage) variations. As noted previously, circuit 17 includes a primary voltage sensing and current regulating arrangement made up of the Zener diode 149, and the voltage divider comprised of resistors 145 and 147 providing a bias potential to the base electrode 143 of the current controlling transistor 141. The change in bias potential brought on by potential changes sensed in the bus 151 limits the current output from the current regulated transistor 125 seen at its emitter electrode 133.

The pulse driver amplifier stage 47 now receives the constant current, high frequency pulse signal at its input terminal 153. As noted previously, this circuit is a conventional Darlington pair design comprising tandemly coupled transistors 155 and 157, and a diode 163 disposed across the amplifier's output terminals 165 and 176, for transient protection. This circuit provides to the base electrode 169 of the high power transistor 171 with the drive necessary for this power stage to produce, through the primary winding 181 of the transformer 183, a constant current, high potential, high frequency pulse signal at the secondary winding 191 that drives the external conventional "coil" 53. This produces the required very high potential pulses which are uniform in magnitude for distribution to the engine's spark plugs.

The driver transformer 183 should be designed for high frequency operation with low loss. For example, this transformer may use an E core design using 0.014 inch laminations of silicon oriented grain iron. Alternately, transformers 185 and 53 may be replaced by a single transformer having the desired high frequency-low loss characteristics with a higher step up ratio to provide the desired very high voltage pulses to the externally located spark plugs.

In order to prevent the possible harmful effects of negative-going transients produced in the primary winding 181 of transformer 183 (due to the inductive load) from reaching the sensitive transistor circuitry of the system, diode 71 is disposed in series with primary potential source from the key switch found at terminal 65. Both diodes 71 and 187 act as protection diodes if a reverse polarity potential is accidentally applied to the system.

It has been found in conventional systems that at the time when the primary potential source (storage battery) is used to activate the engine's starting motor, there is a great amount of current utilized (usually over 200 amps) and the voltage appearing at the ignition system drops due to the internal resistance of the source. This, of course, causes the voltage available at spark plugs to be lower than desirable for reliably starting the engine. In order to overcome this problem, the present system may include a storage capacitor 215 (approximately 2,500 μfd.) connected between ground and the unswitched positive input terminal 61. Prior to the time the starter motor is energized, the capacitor 215 is charged to its maximum capacity. Then, it can provide the desired constant potential level to the amplifier/transformer circuitry for the limited time period that the system's primary potential source is being heavily drained in starting the engine.

Figure 6:
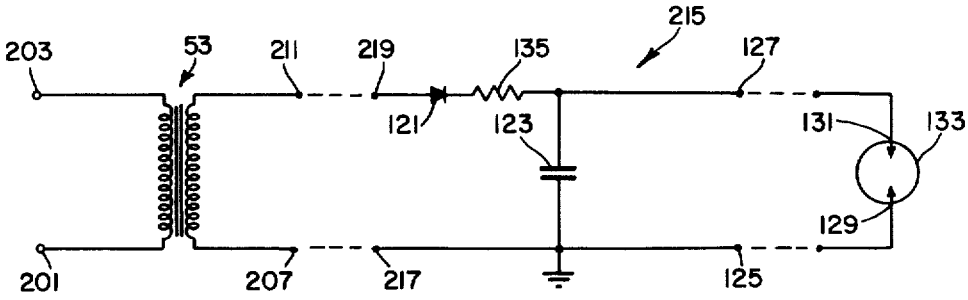
FIG. 6 is a schematic illustration of a high spark energy circuit in accordance with still another embodiment of the present invention.

Yet another embodiment of the invention, which incidentally can be used with any electronic ignition system producing pulses of high frequency energy, is illustrated in FIG. 6. Here there is shown a spark energy intensifier circuit 215 which has input terminals 217 and 219 coupled to the output of a high frequency CW ignition system, such as terminals 207 and 211 of the ignition coil 53, for example.

The circuit 215 includes a diode rectifier 121 connected in series with a rectified energy storage capacitor 123 between the input terminals 117 and 119. Output terminals 125 and 127 are connected across the capacitor 123 and are coupled by appropriate wiring (and usually a distributor) to the terminals 129 and 131 of a conventional spark plug 133.

High frequency energy appearing across the input terminals 117, 119 is rectified by the rectifier 121 and appears across the capacitor 123. The capacitor thus begins its charge cycle. The voltage seen across the capacitor 123, and the output terminals 125 and 127 is also applied across the spark plug points 129 and 131, and when this potential reaches a sufficient magnitude, as determined largely by the gap distance at the plug, an arc will occur and the capacitor is immediately discharged.

In conventional ignition systems, about 6 to 15 thousand volts is applied across the points which are gapped to arc at this potential. On the other hand, in the present invention the gap may preferably be widened so that as the rectified potential reaches approximately 15 to 20 thousand volts, a spark will occur across the points 129, 131 to discharge the capacitor and start a new cycle.

In an application where an 8 cylinder engine is operating at 12,000 RPM and the distributor cam angle is 30°, the distributor rotor speed is 6,000 RPM or 100 revolutions per second and rotates through 36,000 degrees. When each plug is reached every 45° of rotor rotation (for eight plugs), 800 pulses per second will occur, and the period between each such pulse is 12.5 milliseconds. However, since the cam angle is set at 30°, the pulse width of each pulse may be calculated from $$\text{Pulse Width} = \frac{\text{Cam Angle}}{360^\circ} \times \frac{1}{\text{Rotor RPM}} \times \text{seconds.}$$

In this example, the pulse width will be 800 μsec. Where the spark plug gap is set so that a spark will occur when the potential across the points reach approximately 20 kv, the charge/discharge time is approximately 30 μsec. Thus it can be seen that the approximately 27 discharges per pulse (800/30) of rectified energy will occur for the parameters set by this example.

To be stressed in connection with this embodiment is the greatly increased energy released in the combustion chamber of the internal combustion engine. The discharge energy for the capacitor 123 may be calculated from the relationship of $$E = CV^2/2 \text{ joules,}$$

where C is the capacitance (usually between 500 and 1,000 pfd) of the capacitor and V is the voltage across the capacitor (and across the spark plug points) at the time it is discharged. It has been found that this circuit provides approximately 10,000 times more energy at the spark plugs than is available in a conventional ignition system.

Although the rectifier 121 is illustrated as a single unit, it may consist of several series-connected rectifiers having lower voltage ratings than that required for a single unit. Of course, the voltage rating of the capacitor 123 should be sufficient for reliable operation at the operating potential. Also, a current limiting resistor 135 may be incorporated in the series circuit, depending upon the characteristic of the diode or diodes 121.

Another advantage of this embodiment of the invention is that the cam angle ("on time") may be increased while decreasing the dwell angle ("off time"). However, where a cam angle over 30° is to be utilized in an engine speed range over 10,000 RPM, a light emitting diode (LED) or magnetic distributor timing arrangement should be used.

From the foregoing, it should be evident that there has herein been described a new and useful solid state ignition system providing a very desirable high frequency, constant current pulse energy output for the ignition system of an internal combustion engine, and which provides for greatly increased energy release in the combustion chamber for ignition.

Although the present invention has been shown and described with reference to particular embodiments, it should be understood that various changes and modifications which are obvious to persons skilled in the art to which the invention pertains are deemed to lie within the spirit, scope and contemplation of the invention.

What is claimed is:

1. An electronic ignition system for use with an internal combustion engine ignition system and a relatively low direct current potential source, said internal combustion engine ignition system providing ignition timing signals, comprising:

triggered oscillator means including a relatively high frequency non-inductive free running energy generator for providing pulses of oscillator energy in response to relatively low frequency ignition timing signals;

a switch circuit including input terminals coupled between the input of said triggered oscillator means and said ignition timing signals;

a time-on limit circuit means coupled between the input of said triggered oscillator means and said ignition timing signals for limiting the on time of said switch circuit, said timing signals being produced by a set of ignition points in series with said potential source, said time-on limit circuit means including a collector/emitter junction of an input switching transistor connected to the input terminals of said switch circuit, said input switching transistor including a base coupled to said timing signals through a series coupling capacitor and having a timing/coupling capacitor discharge resistor for limiting the conducting time of said input switching transistor to a predetermined value greater than the slowest normal operating period of said system;

constant-current pulse circuit means responsive to the level of said direct current potential source and coupled to said oscillator means for providing constant current pulses of energy in response to said pulses of oscillator energy over potential levels of said direct current potential source above and below a nominal level; and output circuit means coupled to said constant current pulsed circuit means for providing relatively high-potential, high-frequency, constant-current combustion initiating pulses of output energy in direct relationship to and over the entire frequency range of said ignition timing signals.

2. The electronic ignition system according to claim 1, wherein said switch circuit comprises a fast rise time switch circuit having a rise and fall time characteristic less than about 0.1 μs.

3. The electronic ignition system according to claim 1, wherein said time-on limit circuit means also includes diode means connected between said timing/coupling capacitor and said base of said input switching transistor for rapidly discharging any charge on said timing/coupling capacitor once said ignition points close.

4. An electronic ignition system for use with an internal combustion engine ignition system and a relatively low direct current potential source, said internal combustion engine ignition system providing ignition timing signals, comprising:

trigger oscillator means including a relatively high frequency non-inductive free running energy generator for providing pulses of oscillator energy in response to relatively low frequency ignition timing signals;

constant-current pulse circuit means responsive to the level of said direct current potential source and coupled to said oscillator means for providing constant-current pulses of energy in response to said pulses of oscillator energy over potential levels of said direct current potential source above and below a nominal level;

output circuit means coupled to said constant-current pulsed circuit means for providing relatively high-potential, high-frequency, constant-current combustion-initiating pulses of output energy in direct relationship to and over the entire frequency range of said ignition timing signals; and initial boost circuit means coupled to said output circuit means for storing potential energy prior to introducing a heavy load on said potential source, and supplying energy to said output circuit means at times when the potential of said potential source is reduced under heavy load conditions.

* * * * *